United States Patent [19]

Honjoh et al.

[11] Patent Number: 4,718,394

[45] Date of Patent: Jan. 12, 1988

[54] IGNITION DEVICE FOR AN INTERNAL COMBUSTION ENGINE

[75] Inventors: Yoshihisa Honjoh; Hiroshi Okuda, both of Himeji, Japan

[73] Assignee: Mitsubishi Denki Kabushiki Kaisha, Tokyo, Japan

[21] Appl. No.: 1,881

[22] Filed: Jan. 9, 1987

[30] Foreign Application Priority Data

| | | | |
|---|---|---|---|
| Jan. 17, 1986 | [JP] | Japan | 61-8310 |
| Jan. 17, 1986 | [JP] | Japan | 61-8309 |
| Jun. 11, 1986 | [JP] | Japan | 61-135373 |
| Oct. 31, 1986 | [JP] | Japan | 61-261211 |

[51] Int. Cl.[4] ..... F02P 3/06

[52] U.S. Cl. ..... 123/599; 123/618

[58] Field of Search ..... 123/599, 618, 648

[56] References Cited

U.S. PATENT DOCUMENTS

| | | | |
|---|---|---|---|
| 3,885,542 | 5/1975 | Haubner et al. | 123/599 |
| 3,960,129 | 6/1976 | Hofer et al. | 123/599 |
| 4,347,827 | 9/1982 | Lo Cascio | 123/618 |
| 4,558,683 | 12/1985 | Okuda | 123/599 |
| 4,615,318 | 10/1986 | Imoto et al. | 123/618 X |

*Primary Examiner*—Michael Koczo

*Attorney, Agent, or Firm*—Oblon, Fisher, Spivak, McClelland & Maier

[57] ABSTRACT

An ignition device for an internal combustion engine comprises a generating coil, an ignition circuit including an ignition capacitor, a signalling coil connected to the ignition circuit, and a switching means which renders the ignition signal to become ineffective on the basis of the latter half cycle of the ignition signal generated from the signalling coil and renders the ignition signal to become effective by releasing the ineffective condition of the ignition signal on the basis of the former half cycle, whereby the ignition signal is supplied to the ignition circuit within an ignition signal ineffectual period.

8 Claims, 22 Drawing Figures

FIGURE 1
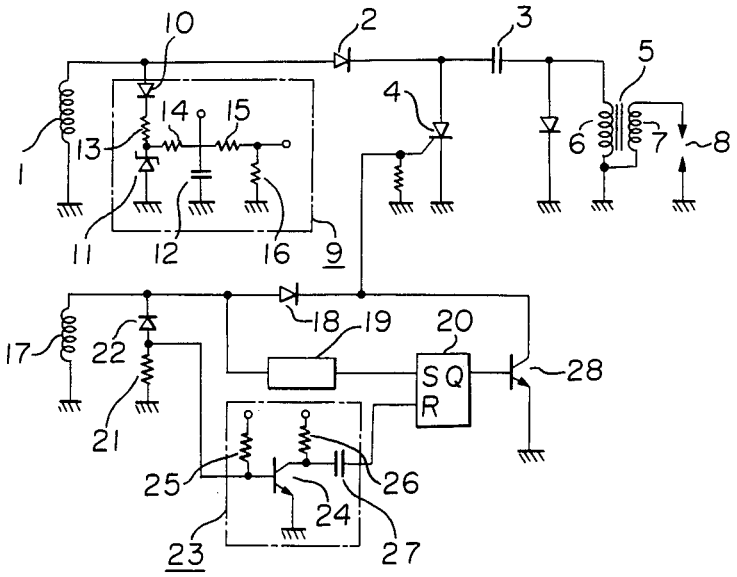
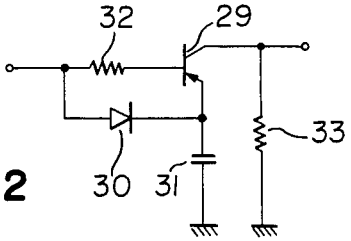
FIGURE 2

IGNITION DEVICE FOR AN INTERNAL COMBUSTION ENGINE

BACKGROUND OF THE INVENTION

1. Field of the Invention

The present invention relates to an ignition device for an internal combustion engine. More particularly, it relates to such ignition device to prevent erroneous operations of it due to noises in a signal circuit of the ignition device and to provide proper ignition characteristics.

2. Discussion of Background

FIG. 21 is a circuit diagram showing a conventional signal circuit having a noise mask function of an ignition device disclosed in Japanese Unexamined Patent Publication No. 6072/1985. In FIG. 21, a reference numeral 40 designates a generating coil, numeral 41 designates a diode for rectifying an output from the generating coil, numeral 42 designates a capacitor, numeral 43 designates a thyristor for ignition, numeral 44 designates an ignition coil, numeral 45 designates a spark plug, and numeral 46 designates a signalling coil connected to the gate of the thyristor 43 through a diode 47 and a resistor 48.

A numeral 49 designates a signal by-passing transistor whose base is connected to the generating coil 40 through a diode 50 which allows to pass a negative wave, while the base is supplied with a constant voltage from a power source circuit 51 through a resistor 52. A diode 53 and a resistor 54 are connected to the power source circuit so as to pass the negative wave generated from the generating coil 40.

The generating coil 40 generates an a.c. power by the revolution of a magnetic generator and each positive half wave charges the capacitor 42 through the diode 41. When the thyristor 43 receives a signal at its gate in an ignition period, the thyristor 43 is turned on so that an electric charge in the capacitor 42 is discharged to the primary winding of the ignition coil 44. Then, a voltage is induced in the secondary winding to result an electric discharge at the ignition plug 45 to thereby fire a cylinder of the internal combustion engine. The negative wave from the generating coil 40 flows through the diode 53 and the resistor 54, and a voltage corresponding to a voltage drop by the resistor 54 appears at both ends of the generating coil 40.

The power source circuit 51 is adapted to receive power from the generating coil 40 and outputs a constant voltage.

The signalling coil 46 generates a signal voltage depending on the revolution of the magnetic generator. However, when the generating coil 40 produces the positive voltage and is charging the capacitor 42, the output of the signalling coil 46 is by-passed and is not supplied to the thyristor 43 because a voltage from the power source circuit 51 is supplied to the base of the transistor 49 to render it in a conductive state. When the charging of the capacitor 42 is finished and the voltage in the generating coil 40 is reversed to generate a negative voltage, a voltage corresponding to a voltage drop of the resistor 54 is applied across the emitter-base of the transistor 49. When the emitter-base voltage is higher than the voltage from the power source circuit 51, the transistor 49 is turned off, whereby the voltage of the signalling coil 46 is applied to the gate of the thyristor 43 to thereby fire the engine. Namely, the conventional ignition device has such construction that the transistor 49 is in an ON state to by-pass a noise signal while the voltage of the generating coil is positive. Accordingly, the device is very effective when it is used for a system that ignition is carried out at every one cycle of a voltage waveform produced by the generating coil 40.

However, when the conventional device is used for a generator, for instance, having four poles in which one ignition signal is to be produced in every one revolution, the following disadvantage is found. Namely, since the generating coil generates an ignition signal in every two cycles, when the voltage of the generating coil becomes negative after charging of the capacitor in the first one cycle, the noise mask is not formed with the result of erroneous ignition.

In some types of the internal combustion engines, it is desirable to have a constant ignition timing from the starting of the engine to a high speed region. However, a voltage waveform produced by a signalling coil attached to the magnetic generator varies depending on an angular position and the peek value becomes high depending on increase in the revolution. Accordingly, some delay of the ignition timing in the starting region is inavoidable. To eliminate this disadvantage, there has been proposed a technique as shown in Japanese Examined Utility Model Publication No. 41618/1978 in which a bias voltage is applied to an output from the signalling coil so that a signal voltage is compensated in a low speed region. However, the technique is applicable only when the engine is started or the bias voltage is to be low, and accordingly, erroneous operations by noises in a signal line are unavoidable.

Further, in an internal combustion engine having more than two cylinders to which the conventional device is applied, when a noise is produced in the signalling coil in the time when the noise masking is removed, the noise causes an erroneous ignition. For instance, when the noise is produced in the second cylinder prior to the normal ignition of the first cylinder, the normal ignition does not take place.

Furthermore, in a multicylinder type ignition device, when a noise voltage is produced in the signalling coil in a cylinder other than the specific cylinder which is intended to cause ignition, during removal of the masking, a thyristor for the other cylinder is triggered prior to the normal ignition of the specific cylinder to thereby cause the erroneous operation.

SUMMARY OF THE INVENTION

It is an object of the present invention to provide an ignition device for an internal combustion engine capable of preventing an erroneous ignition by noises in the ignition circuit of the internal combustion engine having a single or plural cylinders.

The present invention is to provide an ignition device for an internal combustion engine which comprises a generating coil for generating a charging output depending on the rotation of an internal combustion engine, an ignition circuit including an ignition capacitor charged by the charging output generated from the generating coil, a signalling coil connected to the ignition circuit and generating an a.c. signal including a continous one cycle in response to a given crank angle of the engine, and a switching means which renders the a.c. signal to become ineffective on the basis of the latter half cycle of the a.c. signal from the signalling coil and renders the signal to become effective by releasing the ineffective condition of the signal on the basis of the former half cycle, whereby the signal is supplied to the ignition circuit within an ignition signal ineffectual period.

The present invention is to provide an ignition device for an internal combustion engine which comprises a generating coil for generating a charging output depending on the rotation of an internal combustion engine; an ignition circuit including an ignition capacitor charged by the charging output generated from the generating coil, a plurality of ignition coils which correspond to each cylinder in the internal combustion engine; a plurality of signalling coils which correspond to each of the cylinders of the engine, in which a first coil produces an a.c. signal including a continuous one cycle at a reference position for ignition for a specified one among the plural cylinders and a second coil produces an a.c. signal including continuous one cycle at a position immediately after the reference position for ignition, and a noise masking circuit which masks the output from each of the signalling coils when charging of the ignition capacitor is initiated; remove the masking upon detection of a first wave of the ignition signal from either of the signalling coils, and causes firing of the ignition coil at the rising point in the positive polarity of a second wave.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein;

FIG. 1 is a circuit diagram of a first embodiment of the ignition device for an internal combustion engine;

FIG. 2 is a circuit diagram of an embodiment of the peek detection circuit shown in FIG. 1;

DETAILED DESCRIPTION OF THE PREFERRED EMBODIMENTS

Figure 3:
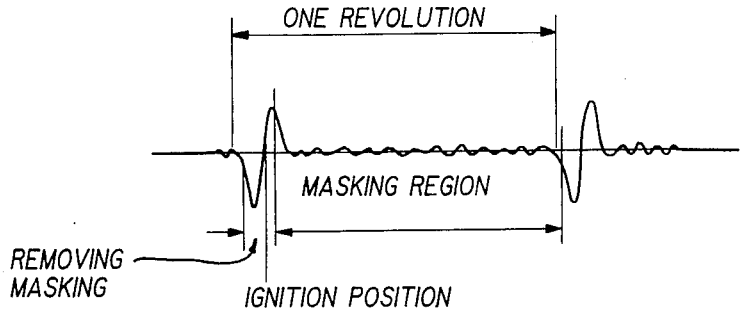
FIG. 3 is a diagram showing the operation of the ignition device according to the first embodiment of the present invention.

Several embodiments of the present invention will be described with reference to figures.

In FIG. 1, a reference numeral 1 designates a generating coil provided in a magnetic generator. A diode 2 and capacitor 3 are connected in series to the generating coil. The diode 2 rectifies an output of the generating coil 1 to charge the capacitor 3. A thyristor 4 is connected between the diode 2 and the capacitor 3 to operate in such a manner that when the gate of the thyristor receives a signal for ignition of the engine, the thyristor turns on to discharge an electric charge in the capacitor 3 to the primary winding 6 of an ignition coil 5. Then, a high voltage is induced in the secondary coil 7 and an electric discharge takes place in an ignition plug 8 whereby the engine is fired.

A constant voltage circuit 9 is supplied with a power from the generating coil 1 and it supplies a constant voltage to a signal controlling circuit which will be described below. The constant voltage circuit is constituted by a diode 10, a constant voltage element 11, a capacitor 12 and resistors 13, 14, 15, 16.

A signalling coil 17 is so adapted that it generates a signal having positive and negative waveforms as shown in FIG. 3; the positive wave is, on one hand, supplied to the gate of the thyristor 4, as an ignition signal, through a diode 18, and on the other hand, is supplied to the set terminal of an R-S flip-flop circuit 20 (hereinbelow, referred to as an f-f circuit) through a peak detector 19. The negative wave from the signalling coil 17 flows through a resistor 21 and a diode 22 to be detected as a voltage drop component in the resistor 21 and is supplied to a waveform shaping circuit 23. The waveform shaping circuit 23 is constituted by a transistor 24, resistors 25, 26 and a capacitor 27 and it outputs a signal to the reset terminal of the f-f circuit 20. The output terminal Q of the f-f circuit is connected to the base of a transistor 28 which constitutes a by-pass means for the ignition signal circuit.

The peak detection circuit 19 may be formed by a transistor 29, a diode 30, a capacitor 31 and resistors 32, 33 as shown in FIG. 2.

Figure 4:
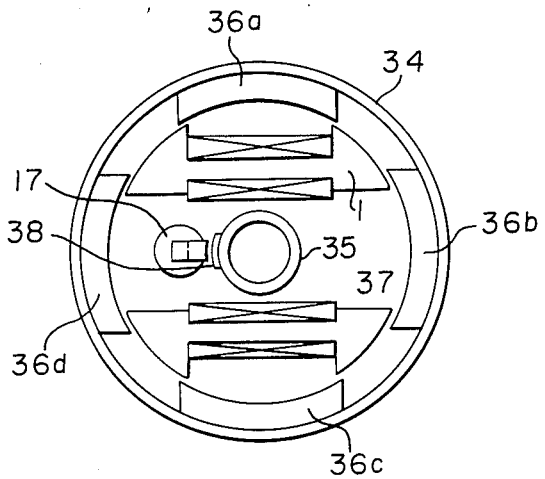
FIG. 4 is a plane view of a magnetic generator for the ignition device of the present invention.
Figure 5:
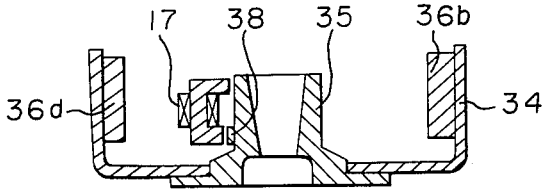
FIG. 5 is a cross-sectional view of the magnetic generator shown in FIG. 4.

FIGS. 4 and 5 show the construction of the magnetic generator having the generating coil 1 and the signalling coil 17 used for the first embodiment. In FIGS. 4 and 5, a numeral 34 designates a cup-shaped rotor provided with a boss 35 at its revolution center which comprises four magnets **36*a*, 36*b*, 36*c*, 36*d* on the inner circumference of the cylindrical part and the generating coils 1 and 37 are provided on the stator so as to face the magnets. On the other hand, a magnet 38 for signalling coil is fixed onto the outer circumference of the boss 35. The signalling coil 17 is provided at the side of stator so as to form a magnetic path passing through the magnet 38 and the boss 35**.

The operation of the first embodiment will be described with reference to FIGS. 2 and 3.

The generating coil 1 generates a power depending on the revolution of the magnetic generator and charges the capacitor 3. A part of the power is supplied to the constant voltage circuit 9 in which the voltage is clipped by the constant voltage element 11. The clipped voltage is charged in the capacitor 12. The terminal voltage of the capacitor 12 subjected to voltage division is used for the waveform shaping circuit 23 and the f-f circuit 20 as a power source.

When the magnetic generator having the construction as shown in FIGS. 4, 5 is rotated, the signalling coil 17 produces an a.c. voltage including continuous one cycle for every one revolution of the generator. Here, it is assumed that the former half cycle in the one cycle in the voltage waveform is referred to as a negative wave and the latter half cycle is a positive wave. The positive wave is supplied to the gate of the thyristor 4 through the diode 18 to turn on the thyristor 4, whereby the electric charge in the capacitor 3 is discharged to the ignition coil 5 to fire the engine. The position of firing at this moment is determined by a value that the positive voltage from the signaling coil reaches the sum of about 0.6 V as a component of voltage drop in the diode 18 and about 0.6 V of the triggering voltage for the thyristor 4, as shown in FIG. 3.

The positive voltage from the signalling coil 17 is applied to the peak detector 19. In the case that the peak detector 19 is constituted by the circuit as shown in FIG. 2, the positive voltage is applied to the base in the transistor 29 through the resistor 32 and the emitter of the transistor 29 as well as the capacitor 31 through the diode 30. The capacitor 31 is charged by the positive power. When the voltage of the positive half wave is increasing, the potential of the emitter is lower than that of the base in the transistor 29. Accordingly, the transistor 29 is kept in an off state. However, when the positive half wave exceeds the peak value, the transistor 29 is turned on since the emitter potential becomes higher than the base potential due to the fact that the capacitor 31 is charged with substantially peak value of the positive voltage with the consequence that the electric charge in the capacitor 31 is discharged through the resistor 33, and at the same time, the terminal voltage of the capacitor 31 is applied to the set terminal S of the f-f circuit 20. On application of the signal to the S-terminal, the output terminal Q is changed to a high level, and the high level voltage is applied to the base of the transistor 28 to actuate it. Then, a by-pass circuit is formed for the gate circuit of the thyristor 4 so that an ignition signal is not supplied to the thyristor 4. Since the f-f circuit 20 is kept to be the high level, the transistor 28 is kept active until another signal is applied to the reset terminal R of the f-f circuit 20. The signalling coil 17 again produces the positive and negative half waves in the next one revolution of the magnetic generator. In this case, the former half cycle is negative voltage as described above, and the negative voltage is supplied to the resistor 21 and the diode 22 to produce a negative voltage drop at boss ends of the resistor 21. The voltage appearing in the resistor 21 is applied to the emitter-base of the transistor 24 in the waveform shaping circuit 23. The transistor 24 usually receives a voltage from the constant voltage circuit 9 through the resistor 25 to be active, whereby the voltage supplied from the constant voltage circuit 9 through the resistor 26 is short-circuited. However, when the negative voltage is applied to the transistor 24, it is turned off. Accordingly, a voltage at the collector is applied to the reset terminal R of the f-f circuit 20 after the voltage has been transformed into a differential wave by the capacitor 27. Then, the output terminal Q becomes a lower level to thereby turn off the transistor 28.

Referring to FIG. 3, the transistor 28 is turned off by the first negative half wave and then, an ignition signal is supplied to the thyristor 4 at a point of rising portion of the coming positive half wave (near the zero cross point of the positive voltage) and thereafter, the transistor 28 is turned on at the point near the peak value of the positive half wave (specifically at a point exceeding the peak). The transistor 28 continues an ON state until the next negative half wave comes. Thus, the signal circuit producing an ignition signal from the signalling coil 17 is masked in the entire portion of the one revolution of the magnetic generator except for a period from the starting of the negative half wave to the peak point of the subsequent positive half wave.

For an ignition system in the magnetic generator used for a small engine or an outboard engine, the signalling coil is generally provided inside the magnet type generator. In this case, there is also provided a magnet for power generation in addition to a magnet for producing a signal. Further, a magnetic flux is produced owing to armature reaction by a power generating coil with the consequence that the voltage generated by the signalling coil includes much quantity of noises as shown in FIG. 3. Increase in the revolution of the engine produce an increased noise voltage thereby resulting erroneous operations of the ignition circuit.

In the first embodiment shown in FIG. 1, it is possible to mask the substantially entire period of the one revolution except for the sections of the negative half wave and a part of the positive half wave. Since the signal voltage is sufficiently higher than the noise voltage during the negative half wave, the noise voltage is absorbed by the negative voltage whereby the erroneous operations caused by the noise voltage can be certainly prevented.

Figure 6:
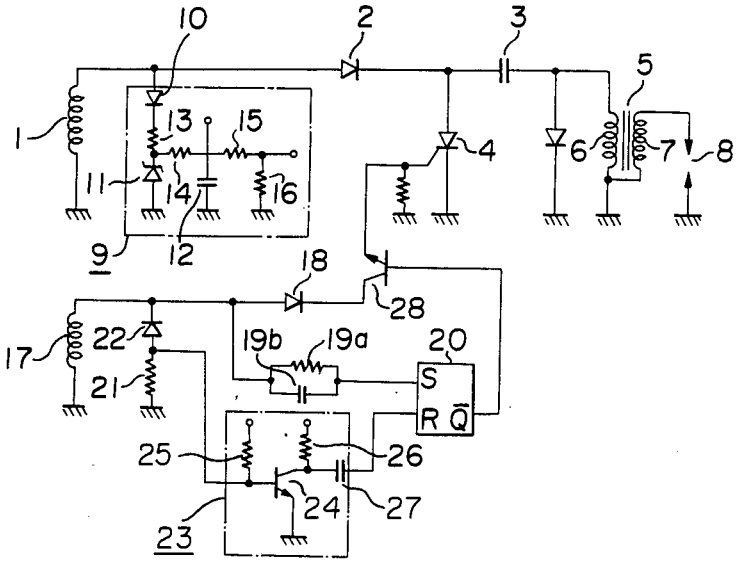
FIG. 6 is a circuit diagram showing a modified form of the first embodiment of the present invention.

FIG. 6 is a circuit diagram showing a modification of the first embodiment. The circuit in FIG. 6 is same as that in FIG. 1 except that the peak detector 19 is constituted by a CR bias circuit consisting of a resistor **19*a* and a capacitor 19*b*, and the transistor 28 is connected in series to the ignition signal circuit in which a signal from the $\overline{Q}$ terminal of the f-f circuit 20 is to be supplied to the base of the transistor 28**.

In the embodiment shown in FIG. 6, the masking of the noise is formed by way of interruption of an ignition signal in contrast with the first embodiment in which the signal is by-passed. However, the modified embodiment performs the same function as the above-mentioned embodiment shown in FIG. 1 by the interruption of the ignition signal circuit during the almost part of one revolution of the magnetic generator by using the transitor 28.

An output from the signalling coil may be subjected to double-wave rectification so that it is directly applied to the R terminal of the f-f circuit without passing the negative half wave through the wave form shaping circuit 23. In this case, the circuit of the ignition device may be contructed in such a manner that a voltage remains at the S-terminal of the f-f circuit by giving a large time constant to the CR circuit consisting of the capacitor 31 and resistor 33 of the peak detecting circuit shown in FIG. 2, or the CR circuit consisting of the resistor **19*a* and the capacitor 19*b* as shown in FIG. 6**, whereby the masking is eliminated when a voltage higher than the S-terminal voltage of the f-f circuit is applied to the R-terminal, namely, the peak voltage or a voltage in the proximity of it of the negative half wave is applied to the R-terminal. With such construction, erroneous operations of the circuit can be prevented even though the noise voltage is relatively high.

Thus, in the above-mentioned embodiments, the noise masking is provided by using the voltage generated by the signalling coil, accordingly, a reliable noise masking is obtainable regardless of the number of poles and the number of firing per revolution of the magnetic generator. Further, since the ignition signal itself is not biased, ignition of the engine can be carried out by a constant voltage produced by the signalling coil, and a stable ignition position can be obtained covering both a relatively low speed region and a high speed region.

A second embodiment of the ignition device will be described with reference to FIG. 7.

Figure 7:
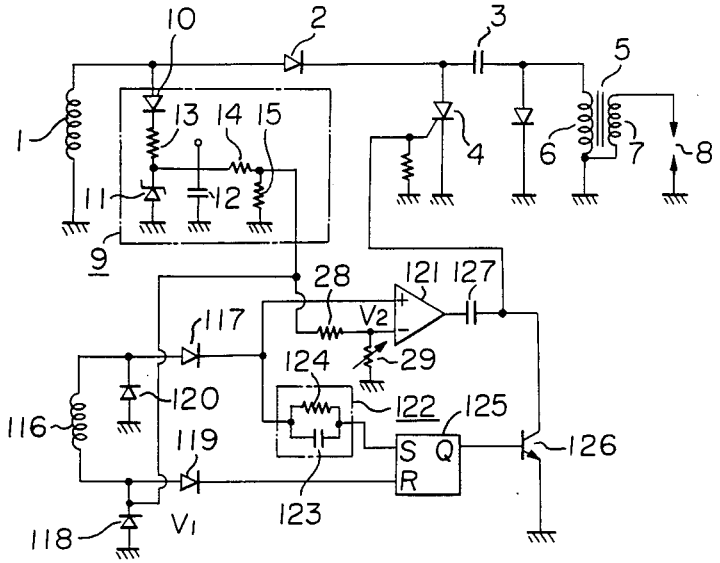
FIG. 7 is a circuit diagram of a second embodiment of the ignition device according to the present invention.

In FIG. 7, the components 1 to 8 of the ignition circuit and a constant voltage circuit 9 are identical with those of the first embodiment shown in FIGS. 1 and 6. Accordingly the same reference numerals designate the same parts. The construction of the magnetic generator having a signalling coil which generates a signal voltage of a continuing one cycle consisting of the negative and positive half waves is also the same as that shown in FIGS. 4 and 5.

Figure 8A:
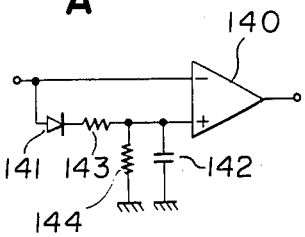
FIG. 8A and FIG. 8B are respectively circuit diagrams showing embodiments of the peak detection circuit used for the second embodiment of the present invention.
Figure 8B:
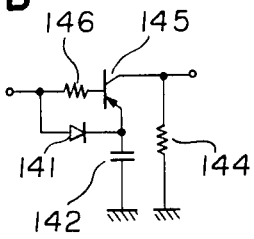
Figure 9:
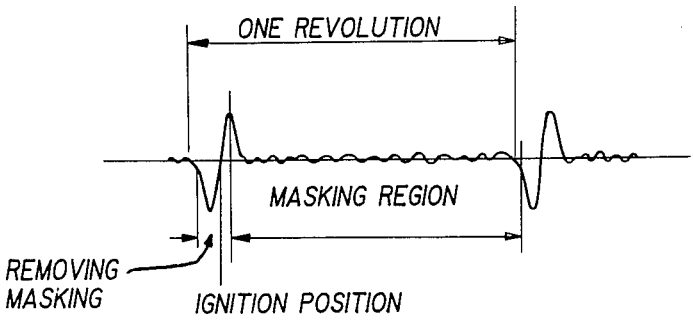
FIGS. 9 and 10 are diagrams showing the operations of the second embodiment of the present invention.

In FIG. 7, a reference numeral 116 designates a signalling coil provided in the magnetic generator to produce an a.c. voltage having the positive and negative half waves as shown in FIG. 9. The a.c. voltage is subjected to double-wave rectification by the diodes 117, 118, 119 and 120. The rectified positive wave is, on one hand, applied to a non-inversion input terminal (hereinbelow, referred to as a positive (+) terminal) of a voltage comparator 121, and on the other hand, is applied to a set terminal of an RS flip-flop circuit 125 (hereinbelow, referred to as an f-f circuit) through a peak detecting circuit 122. In this embodiment, the peak detecting circuit 122 is constituted by a bias circuit consisting of a resistor 124 and a capacitor 123. It may be, however, replaced by a circuit as shown in FIGS. 8A or 8B which will be described after. The negative wave from the signalling coil 116 is supplied to the reset terminal of the f-f circuit.

A part of the output from the constant voltage power source circuit 9 is supplied to the junction of a diode 118 and the signalling coil 116 so that the output voltage of the signalling coil 116 is constantly biased at the positive side, and at the same time, a voltage of the power source circuit 9 subjected to voltage division by resistors 128, 129 is applied to a non-inversion input terminal (hereinbelow referred to as a negative (−) terminal) of the voltage comparator 121.

When the biased voltage of the signalling coil 116 is $V_1$ and the voltage at the negative terminal of the voltage comparator 121 is $V_2$, a relation of $V_1 > V_2$ is given.

A switching transistor 126 is to by-pass a signal which is outputted from the f-f circuit 125 as a result of determination by the voltage at the output terminal Q and is applied to the gate of the thyristor 4.

A capacitor for differentiation is to apply the output voltage of the voltage comparator 121 to the gate of the thyristor 4.

In the second embodiment having the construction as above-mentioned, the revolution of the magnetic generator generates an output from the generating coil 1. The constant voltage power source circuit 9 outputs a constant voltage on the basis of the output from the generating coil 1 so that the voltage generated from the signalling coil 116 is biased, and at the same time, a constant voltage is applied to the negative terminal of the voltage comparator 121.

The voltage generated from the signalling coil 116 starts from the negative voltage, which is applied to the reset terminal of the f-f circuit through the diodes 119, 120 and then, the output terminal Q of the f-f circuit 125 is changed to a low level to thereby render the transistor 126 to be an off state, namely a by-pass circuit is not formed for the gate circuit of the thyristor 4. Accordingly, any signal is applied to the gate of the thyristor 4.

When the phase of the voltage of the signalling coil changes from the negative polarity to the positive polarity, i.e. it come to the zero cross point, as the revolution of the magnetic generator advances, a summed voltage of the voltage generated by the signalling coil 116 and the biasing voltage by the constant voltage circuit 9 is applied to the positive terminal of the voltage comparator 121. When thus applied voltage becomes higher than the voltage $V_2$ of the negative terminal, the output of the voltage comparator 121 is changed to a high level. The high level voltage is passed through the capacitor 127 for differentiation to be applied to the gate of the thyristor 4, whereby the thyristor 4 is turned on. The activated thyristor 4 discharges the electric charge in the capacitor 3 to the primary winding 6 of the ignition coil 5 thereby firing the engine.

When the voltage of the signalling coil 116 increases to the peak value or the proximity of it by the revolution of the magnetic generator, the output of the peak detecting circuit 122 is supplied to the set terminal of the f-f circuit 125 to change the output of the output terminal Q to be a high level; thus the transistor 126 is turned on. Under the condition that the transistor 126 is activated to form the by-pass circuit for the gate circuit of the thyristor 4, any signal is not applied to the thyristor 4 until the f-f circuit 125 is again reset.

Since the peak detecting circuit is of a CR circuit, the capacitor 123 is charged by the output signal of the signalling coil 116 and its electric discharge is gradually is carried out at a given time constant. In this case, the time constant is determined so as to allow the entrance of the next signal before the voltage is substantially reduced, whereby the next signal can be passed at the peak value or the proximity of the peak value in the half cycle of the positive voltage. As shown in FIG. 9, an ignition signal is received by the gate of the thyristor 4 by turning off the transistor 126 only when the ignition signal voltage is in the period from a predetermind point of the negative half wave to the peak value of the positive half wave in the continuing negative-positive voltage waveform, and the ignition signal is by-passed in the other period.

Since the output of the signalling coil 116 is biased by the biasing voltage $V_1$ and the negative terminal of the voltage comparator 121 receives the voltage $V_2$, the relation $V_1 > V_2$ is given. Accordingly, the voltage comparator 121 generates an ignition signal by receiving a relatively low voltage from the signalling coil 116. It is possible to realize the ignition at the zero cross point (namely, a transition point from the negative voltage to the positive voltage in the voltage waveform by the signalling coil 116) by making a voltage $(V_1 - V_2)$ equal to a voltage-drop in the signalling coil circuit, i.e. a forward flow blocking voltage of the diodes 117, 118.

Further, it is possible to realize the ignition by the negative voltage having a positive value of dv/dt.

Figure 10:
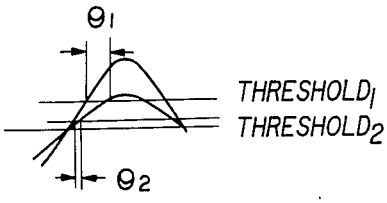

In the ignition at the zero cross point, if the threshold value of the gate is large, this causes deflection in the position of ignition $\theta_1$ depending on the signal waveform between a low voltage of the signalling coil at a low speed and a high voltage of the signalling coil at a high speed. However, such deflection can be made small at the ignition position $\theta_2$ in the vicinity of the zero cross point as shown in FIG. 10, whereby a stable ignition can be obtained even in a low speed region; thus, a stable function of the engine can be attained.

Generally, erroneous ignition easily takes place due to the noise voltage generated in the signalling coil 116 when the ignition is to be produced near the zero cross point. However, the ignition device of the present invention permits the ignition near the zero cross point without the erroneous operation by forming the abovementioned noise-masking circuit.

In the second embodiment having the same construction of the magnetic generator as that shown in FIGS. 4 and 5, various noise voltages are generated in the signalling coil by the influence of the magnets 36 and the armature reaction of the generating coil 37. In the conventional circuit with a noise mask in the ignition device, it has been impossible to realize the ignition near the zero cross point. However, by the present invention, stable ignition can be obtained near the zero cross point, and stability in the operations of the engine can be remarkably improved.

The noise masking is removed by the voltage signal in the former half cycle, and a voltage having the inverse polarity with respect to the ignition signal voltage is applied to the signalling coil in the period from the elimination of the noise mask to the ignition. Accordingly, the noise voltage is inverse biased by the voltage so that erroneous operations are prevented.

Now returning to the explanation of the peak detecting circuit as shown in FIG. 8A and FIG. 8B.

In FIG. 8A, the peak detecting circuit is constituted by a voltage comparator 140, a diode 141, a capacitor 142 and resistors 143, 144. When the voltage of the signalling coil 116 is applied, charging of the capacitor 142 is started. Due to a voltage drop caused by the charging, the potential of the positive terminal becomes low and the output of the voltage comparator is kept at a low level. When the output voltage of the signalling coil 116 becomes lower than the peak value, the potential of the negative terminal is decreased. However, the potential of the positive terminal is kept at the voltage level of the capacitor 142 as the consequence that the output terminal of the voltage comparator 140 becomes a high level, whereby the f-f circuit 125 is set. Namely, the peak detecting circuit detects a point just after the peak value of the voltage. The resistor 143 determines a constant for charging and the resistor 144 determines a constant for discharging.

In FIG. 8B, the peak detecting circuit is constituted by a transistor 145, a diode 141, a capacitor 142 and resistors 144, 146.

When a voltage of the signalling coil 116 is applied, the capacitor 142 is charged through the diode 141. Due to a voltage drop in the diode 141, the voltage at the emitter of the transistor 145 is lower than that of the base, so that the transistor 145 is kept at an off state. However, when the voltage of the signalling coil exceeds the peak value and begins to decrease, the potential of the capacitor 142 becomes higher, whereby the transistor 145 is turned on and the voltage of the capacitor 142 is applied to the set terminal of the f-f circuit 125. The electric charge of the capacitor 142 is gradually discharged through the resistor 144. Since some amount of voltage remains in the capacitor, the erroneous operation of the f-f circuit 125 does not occur even though a noise voltage is applied to the reset terminal of the circuit 125. Accordingly, the peak detecting circuit shown in FIG. 8B provides a stable, strong noise masking to the ignition signal circuit.

Figure 11:
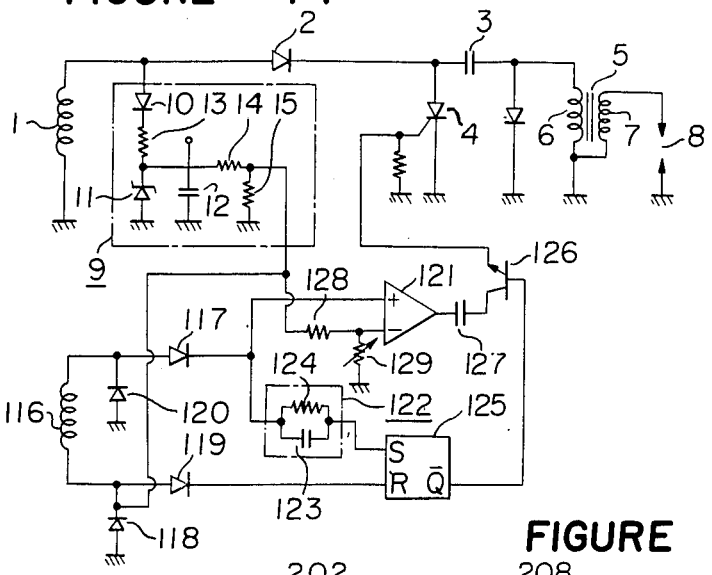
FIG. 11 is a circuit diagram showing a modified form of the second embodiment of the present invention.

FIG. 11 shows another embodiment of the noise masking circuit. This embodiment is identical with the embodiment shown in FIG. 7 provided that the transistor 126 is connected in series to the junction between the capacitor 127 for differentiating the output of the voltage comparator 121 and the gate of the thyristor 4, and the base of the transistor 126 is connected to the negative terminal $\overline{Q}$ of the f-f circuit 125.

The operation of the embodiment shown in FIG. 11 is described with reference to the diagram shown in FIG. 9. When the negative wave from the signalling coil 116 is applied to the reset terminal of the f-f circuit 125, the negative terminal $\overline{Q}$ of the f-f circuit 125 becomes a high level to thereby turn on the transistor 126. Then, as soon as the voltage of the signalling coil 116 has the positive polarity, the output terminal of the voltage comparator 121 is changed to a high level. The change in voltage of the signal is supplied to the gate of the thyristor 4 through the capacitor for differentiation 127 and the transistor 126 to fire the engine. When the voltage of the signalling coil 116 reaches the positive peak value, a signal is supplied to the set terminal S of the f-f circuit 125, so that the negative terminal $\overline{Q}$ is changed to a low level thereby turning off the transistor 126. During the turning off of the transistor 126, any signal to the thyristor 4 is interrupted whereby the erroneous operation by the noise voltage is prevented.

Thus, the second embodiment of the present invention is so constructed that the ignition signal is generated when the voltage of the signalling coil is changed from the negative polarity to the positive polarity or when it reaches near changing point, and the ignition signal is made effective in the period from the negative wave to the peak of the comming positive wave of the voltage generated by the signalling coil. Accordingly, the ignition timing can be kept constant without influence by the change of the revolution of the magnetic generator, and the stability of firing operation of the engine can be improved.

Figure 12:
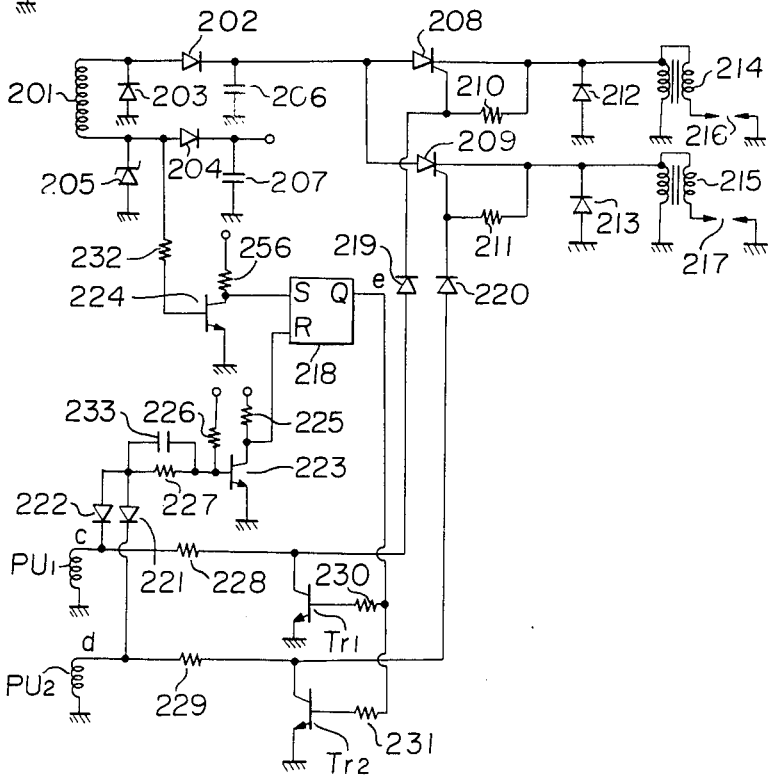
FIG. 12 is a circuit diagram of a third embodiment of the ignition device according to the present invention.

FIG. 12 shows the third embodiment of the ignition device according to the present invention.

In FIG. 12, a reference numeral 201 designates a generating coil, numerals 202 to 204 diodes, numeral 205 a zener diode, numeral 206 a capacitor for ignition, numeral 207 a capacitor, numerals 208 and 209 thyristors for ignition, numerals 210, 211 resistors, numerals 212, 213 diodes, numerals 214, 215 ignition coils, numerals 216, 217 ignition plugs, numeral 218 a flip-flop, numerals 219 to 222 diodes, numerals 223 224 and symbols Tr1, Tr2 transistors, numerals 225 to 232 and 256 resistors, numeral 233 a capacitor and symbols PU1, PU2 signalling coils.

Figure 13:
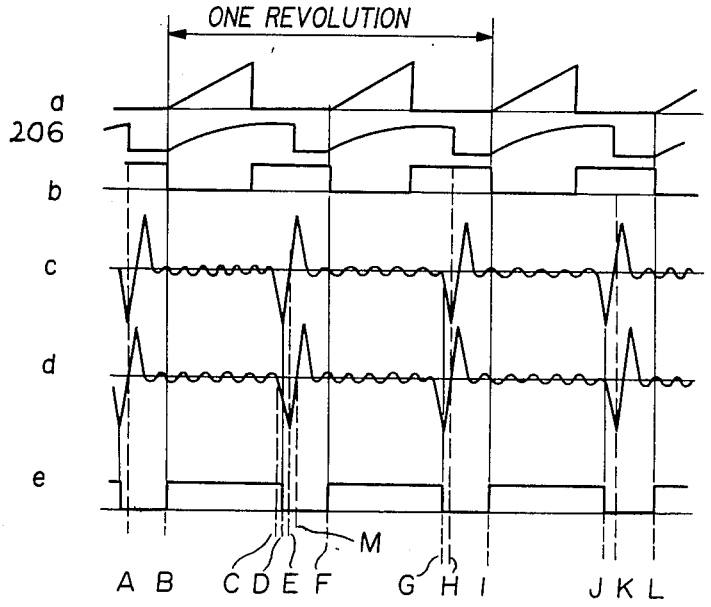
FIG. 13 shows waveforms in the operations of the third embodiment of the present invention.

The generating coil 201 generates signals as shown by a and b in FIG. 13. The signal a charges the capacitor 206 through the diode 202 and the signal b charges the capacitor 207 and the thyristors 208, 209 are respectively turned on by receiving signals at their gates in the period of ignition of the engine, whereby the electric charge of the capacitor 206 is discharged to the ignition coils 214, 215 to spark the ignition plugs 216, 217 thereby firing each cylinder of the engine.

The signalling coils PU1, PU2 respectively generate signals as shown by letters c and d as in FIG. 13. The signal c is applied as an ignition signal to the thyristor 208 through the diode 219, and at the same time, it is inputted to the reset terminal of the flip-flop 218 through the transistor 223.

The signal b is also inputted in the set terminal of the flip-flop 218 through the transistor 224.

The output d of the signalling coil PU2 is applied as an ignition signal to the thyristor 209, and at the same time, is inputted to the reset terminal of the flip-flop 218 throgh the transistor 223. The output from the output terminal Q of the flip-flop 218 is inputted to the transistors Tr1, Tr2 for by-passing signals.

Figure 14:
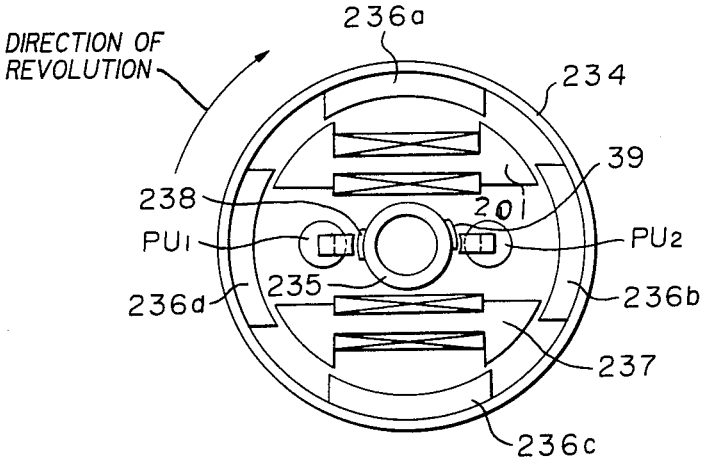
FIG. 14 is a plane view showing the construction of a magnetic generator for the third embodiment.
Figure 15:
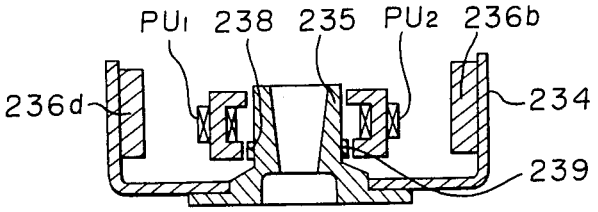
FIG. 15 is a cross-sectional view of the magnetic generator shown in FIG. 14.

FIGS. 14 and 15 show the construction of a magnetic generator provided with the generating coil 201 and the signalling coils PU1, PU2.

A numeral 234 designates a cup-shaped rotor provided with a boss 235 at the center of revolution. Four magnets 236*a* to 236*d* are attached on the inner circumference of the cylindrical part of the rotor 234. Generating coils 201 and 237 are attached to the stator so as to oppose the magnets. Two magnets 238, 239 to generate a signal are attached on the outer circumference of the boss 235. The magnet 238 is to generate a regular signal, and the magnet 239 is to generate a signal for preventing erroneous ignition. Both magnets are provided to have an angular distance slightly greater than the distance of ignition of 180° for the two cylinders. The signalling coils PU1, PU2 are provided at the stator side with the distance of 180° so as to form magnetic paths between the boss 235 and the magnets 238, 239.

The generating coil 201 generates a power depending on the rotation of the magnetic generator and an output signal a charges the capacitor 206. An output signal b is inputted in the base of the transistor 224. The transistor 224 is turned off by a falling point of the output signal b, whereby a signal is supplied to the set terminal of the flip-flop 218 and the output signal e of the flip-flop 218 is changed to a high level.

The signalling coils PU1, PU2 respectively generate output signals c, d. When the negative peak of either of the signals c, d is applied to the base of the transistor 223 in an active state, it is turned off, and a signal is supplied to the reset terminal of the flip-flop 218, whereby the output e of the flip-flop 218 is changed to the low level. Thus, the signal e is in high level in the periods B–D, F–G and I–J. In these periods, the transistors Tr1, Tr2 are on. Accordingly, gate signals to be supplied to the thyristors 208, 209 are by-passed, and therefore, the thyristors are off. Therefore, even though noise signals are generated in the signalling coils PU1, PU2, the erroneous ignition does not occur.

On the other hand, when the flip-flop 218 is in a low level, the thyristors 208, 209 are turned on at the rising point of the positive voltage of the signals c, d to fire the engine. In this case, when the firing of the engine is made by the positive voltage of either early inputted signal in the signals c, d, the capacitor 206 is discharged. Accordingly, the ignition of the engine is not carried out by the positive voltage of the latter signal. Namely, as shown in FIG. 13, the ignition of the ignition coil 214 is made at the rising point of the positive voltage of the signal c at time points E and K, whereas the ignition of the ignition coil 215 is made at the rising point of the positive voltage of the signal d at the time points A and H. In the period of the negative voltage of the signal d such as the period of C–M, even when some noise voltage having the positive polarity is superimposed on the negative voltage of the signal d, the negative voltage is maintained totally. Accordingly, the thyristor 209 does not turn on and erroneous ignition does not occur. The same situation is applicable to the signal d. Thus, the period in which the erroneous ignition may occur can be remarkably shortened.

In the third embodiment, a noise mask is formed by by-passing the ignition signal as soon as charging of the ignition capacitor 206 is started; the mask is removed at the peak or the proximity of the peak of the first waveform of either of the signals c, d from the signalling coils PU1, PU2, and the ignition is carried out at the rising point of the second waveform of the signal. In this case, a signal waveform is generated from the other signalling coil PU1 or PU2 with some delay, whereby the erroneous ignition can be prevented by the delayed signal waveform.

Figure 16:
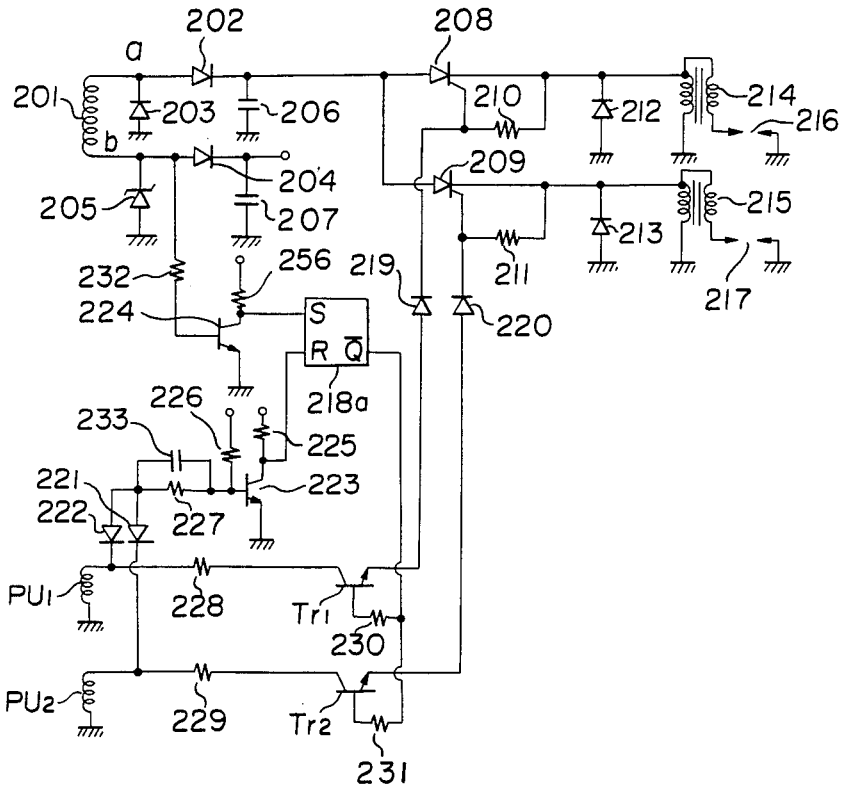
FIG. 16 is a circuit diagram showing a modified form of the third embodiment of the present invention.

FIG. 16 shows a modified form of the third embodiment of the present invention.

In FIG. 16, the transistors Tr1, Tr2 are turned off by the output of the $\overline{Q}$-terminal of a flip-flop 218*a* so that masking for noises produced in the signalling coils PU1, PU2 is formed. The function in this embodiment is the same as that in the by-passing method of the embodiment shown in FIG. 12.

Thus, in accordance with the third embodiment of the present invention, the output of a signalling coil is masked in a period from initiation of charging the capacitor for ignition to the time of generation of the first waveform of an ignition signal for a first cylinder thereby preventing the erroneous ignition caused by noise signals, and ignition is made by the rising point of a second waveform of the ignition signal. Further, an ignition signal for the other cylinder is generated immediately after the first ignition signal to cancel the noise signals during the elimination of the masking thereby preventing the erroneous ignition. Thus, the erroneous ignition by the noise can be prevented even in the internal combustion engine having a plurality of cylinders.

The fourth embodiment of the present invention will be described with reference to FIG. 17.

The fourth embodiment is provided with, in addition to the third embodiment, with a voltage comparing means in the signal circuit. In the fourth embodiment, a signal biasing voltage is made higher than the reference voltage of the voltage comparing means. Accordingly, it is possible to obtain an ignition signal by detecting a voltage such as at the zero cross point of the signalling coil even in the case that the circuit has a voltage reducing element. The conventional technique of d.c. bias is disclosed in, for instance, Japanese Examined Utility Model Publication No. 41618/1978.

Figure 17:
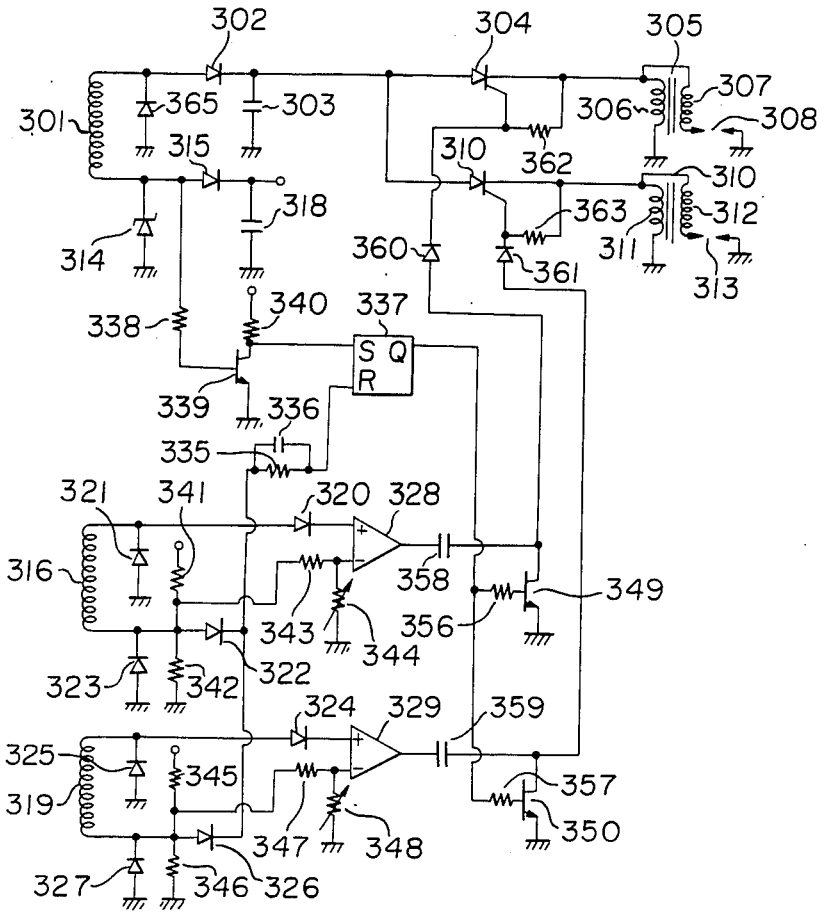
FIG. 17 is a circuit diagram of a fourth embodiment of the ignition device according to the present invention.

In FIG. 17, a numeral 301 designates a generating coil disposed in a magnetic generator, a numeral 302 a diode to rectify the output of the generating coil 301 to charge a capacitor 303. Thyristors 304, 310 are turned on by receiving signals at their gates in the period of ignition of the engine so that the electric charge in the capacitor 303 is discharged to the primary windings 306, 311 of the ignition coils 305, 310 to thereby induce a high voltage at the secondary windings 307, 312. The induced high voltage causes sparks in the ignition plugs 308, 313 to produce ignition of the engine cylinders. A numeral 314 designates a diode for making the negative voltage from the generating coil 301 to be a constant voltage, the constant voltage is charged in a capacitor 318 through a diode 315. A numeral 365 designates a diode for rectifying the negative output of the generating coil 301.

Numerals 316, 319 are respectively signalling coils disposed in the magnetic generator. An a.c. voltage having the positive and negative polarities are subjected to double-wave rectification by the diodes 320, 321, 322, 323, 324, 325, 326, 327 and the positive wave is supplied to a non-inversion input terminal (hereinbelow, referred to as a positive terminal) of each voltage comparator 328 or 329. The negative wave of the signalling coil 316 is supplied to a reset terminal of an RS flip-flop circuit 337 (hereinbelow, referred to as an f-f circuit) through a parallel circuit of a resistor 335 and a capacitor 336.

The voltage of the constant voltage diode 314 is applied to the base of the transistor 339 through the resistor 338 to control turning-on or off of the transistor 339. The diode 314 applies a high level voltage to the set terminal of the f-f circuit 337 through the resistor 340 when the transistor 339 is in the non-activating condition.

The constant voltage of the capacitor 318 is subjected to voltage division by the resistors 341, 342 and then, is applied to the junction between the diode 323 and the signalling coil 316, whereby a constant positive bias is applied to the output voltage of the signalling coil 316. At the same time, the constant voltage is subjected to voltage division by the resistors 343, 344 and the voltage is applied to the non-inversion terminal (the negative terminal) of the voltage comparator 328.

Assuming that the biasing voltage for the signalling coil 316 is expressed by $V_1$, and the voltage at the negative terminal of the voltage comparator 328 is expressed by $V_2$, a relation $V_1 > V_2$ is given.

Simiraly, the resistors 345, 346 bias the voltage of the signalling coil 319 and the divided voltage by the resistors 347, 348 is applied to the negative terminal of the voltage comparator 329.

Numerals 349, 350 designate switching transistors which receive the voltage of the output terminal Q of the f-f circuit 337 through the resistors 356, 357 to thereby by-pass signals to be supplied to the gate circuit of the thyristors 304, 310.

Numerals 358, 359 designate capacitors for differentiation which detect the variation of output voltages from the voltage comparators 328, 329 to supply signals to the gates of the thyristors 304, 310 through the diodes 360, 361. Numerals 362, 363 designate resistors connected between the gate and cathode of the thyristors 304, 310.

The construction of the magnetic generator provided with the signalling coils 316, 319 of the fourth embodiment is identical with that shown in FIGS. 14, 15.

Figure 18:
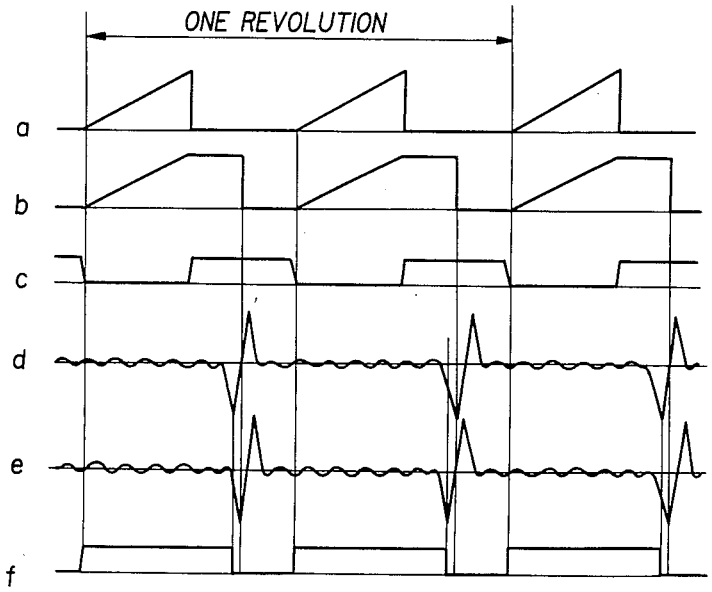
FIGS. 18 and 19 are respectively show waveforms of the operations of the fourth embodiment.

The operation of the fourth embodiment having the above-mentioned construction will be described with reference to a diagram of FIG. 18 showing voltage waveforms.

In FIG. 18, an absissa a shows the positive voltage waveform of the output from the generating coil 301; an absissa b shows the terminal voltage waveform of the capacitor 303; an absissa c shows a negative voltage waveform from the generating coil 301; an absissa d shows a voltage waveform across the output terminals of the signalling coil 316; an absissa e shows a voltage waveform across the output terminals of the signalling coil 319 and an absissa f shows a voltage waveform from the output terminal Q of the f-f circuit.

On initiation of the revolution of the magnetic generator, the generating coil 301 generates an output voltage. The output is charged in the capacitor 318. A constant voltage output from the capacitor 318 biases the voltages generated from the signalling coils 316, 319 and at the same time, applies a constant voltage to the negative terminals of the voltage comparators 328, 329.

The voltages of the signalling coils 316, 319 have a slight phase difference as shown in d and e in FIG. 18. This is because the magnets for producing signals are disposed at angular positions slightly greater than 180° C. as shown in the construction of the magnetic generator of FIG. 14.

As clearly shown in d and e in FIG. 18, the voltage waveforms of the outputs from the coils 316, 319 start from the negative voltage. The negative voltage is applied to the reset terminal of the f-f circuit through the diodes 321, 322 and the parallel circuit of the resistor 335 and the capacitor 336 so that the potential at the output terminal Q of the f-f circuit 337 becomes a low level. Change in voltage at the output teminal Q renders the transistors 349, 350 to be an off state with the result that the ignition signals are applicable to the thyristors 304, 310 without by-passing the gate circuits of the thyristors.

When the voltage generated from the signalling coils comes to a transition point between the negative polarity and the positive polarity, i.e. a zero cross point, a voltage having the output voltage of the signalling coil 316 and the biasing voltage is applied to the positive terminal of the voltage comparator 328. When the voltage level is higher than the negative terminal voltage of $V_2$, an output from the comparator 328 is changed to a high level. This voltage variation is applied to the capacitor for differentiation 358 and the diode 360, and the voltage applied to the gate of the thyristor 304 to thereby turn on the thyristor 304. Then, the electric charge in the capacitor 303 is discharged to the primary winding 306 of the ignition coil 305 to fire a cylinder of the engine.

As the magnetic generator revolutes, the output voltage of the signalling coil 319 is changed from the negative to the positive slightly after the change in polarity of the output signal from the signalling coil 316. At this moment, the output of the voltage comparator 329 becomes a high level to turn on the thyristor 310. However, the ignition coil 310 produces no voltage, hence, no erroneous ignition occurs because the discharge of the capacitor 303 is finished as shown in b in FIG. 18. When the revolution further goes on and the output voltage from the generating coil 301 is changed from the negative to the positive, no voltage appears as shown in the absissa c in FIG. 18. Accordingly, the transistor 339 becomes inactive and a high level voltage is applied to the set terminal of the f-f circuit 337 through the resistor 340 and therefore, the output from the output terminal Q of the f-f circuit 337 becomes high to turn on the transistors 349, 350. Then, a by-pass circuit is formed for the gate circuits of the thyristors 304, 310. In this condition, any signal is by-passed until the f-f circuit 337 is again reset. When the magnetic generator rotates by 180°, the phase of the output voltage of the signalling coil 319 is ahead of that of the signalling coil 316 to trigger the thyristor 310. Thus, two cylinders are alternately fired.

The resistor 335 and the capacitor 336 constitute a CR bias circuit and accordingly, a voltage is left in the capacitor 336 to detect the negative peak value of the signalling coils 316, 319.

As shown in the absissa f in FIG. 18, the transistors 349, 350 are turned off in the time period from the peak value of the negative voltage to the rising point of the positive voltage of the generating coil 310 among the two continuing negative and positive voltage waveforms of the signalling coils 316, 319. The thyristors 304, 310 receive only the above-mentioned gate signals, and signals coming to the thyristors in the period other than the above-mentioned are all by-passed.

On the other hand, the output voltage of the signalling coils 316, 319 are biased by the voltage $V_1$ and the voltage $V_2$ is applied to the negative terminal of the comparators 328, 329 so that a relation $V_1 > V_2$ is established. Accordingly, the voltage comparators 328, 329 generate the ignition signals by receiving relatively low voltages from the signalling coils 316, 319, and it is possible to attain the ignition of the engine at a zero cross point, i.e. a transition point of the output voltage from the negative polarity to the positive polarity of the signalling coils 316, 319 by making the voltage reference $(V_1 - V_2)$ equal to a voltage drop value in each circuit including the signalling coil 316 for 319, namely, voltage drop in the forward direction of the diodes 320, 323 or 324, 327. If necessary, it is possible to attain the ignition by the negative voltage having a positive gradient of dv/dt.

Figure 19:
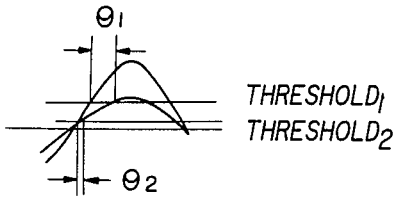

The feature of ignition at the zero cross point is as follows. As shown in FIG. 19, when a threshold value of the gate is greater, this causes deflection of an ignition position of $\theta_1$ depending on a signal waveform in comparing a low voltage of the signalling coil at a low speed with a high voltage at a high speed. However, such deflection becomes small when the position $\theta_2$ is near the zero cross point. Accordingly, a stable ignition position can be obtained in the low speed region, and a stable function of the engine is obtainable.

Generally, there is a problem of erroneous ignition by the noise voltages produced by the signalling coil 316, 319 if the ignition takes place near the zero cross point. However, the present invention permits the ignition at the zero cross point by using the above-mentioned noise mask circuit.

In the magnetic generator having the signalling coil 316, various noise voltages are produced in the signalling coil as shown in d and e of FIG. 18 by influence of the magnets 236 and armature reaction by the generating coil 237. In the conventional ignition device, ignition at the zero cross point is impossible. However, the present invention permits the ignition at the zero cross point and improves reliability of the engine.

Since a voltage having the polarity opposite to the ignition signal voltage is applied to the generating coil during the time period from removal of the noise mask to the ignition, the noise voltage produced in the generating coil is reversely biased, whereby no erroneous operation takes place during the removal of the noise mask. In the present invention, a signal is produced by a signalling coil for a specific cylinder and on the other hand, a signal is produced by another signalling coil for another cylinder with a phase slightly delayed with reference to that of the former signal. Accordingly, either of the signalling coils generates the negative voltage when the mask is removed. Therefore, there is no erroneous ignition of the other cylinder by the noise voltage.

Figure 20:
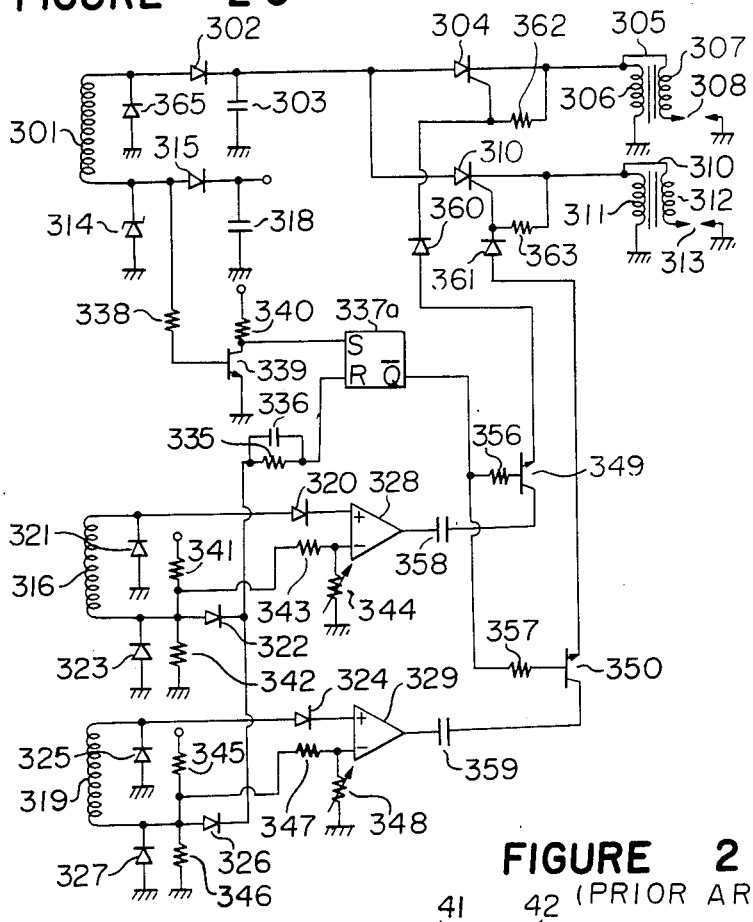
FIG. 20 is a circuit diagram showing a modified form of the fourth embodiment.
Figure 21:
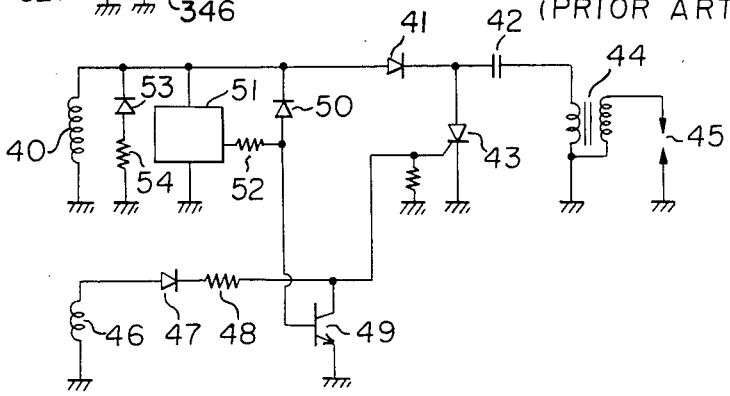
FIGURE 21 (PRIOR ART)
FIG. 21 is a circuit diagram of a conventional ignition device for an internal combustion engine.

FIG. 20 is a circuit diagram of a modified form of the fourth embodiment. The circuit is identical with the fourth embodiment except that the transitors 349, 350 are connected in series between the capacitor 358, 359 for differentiation of the outputs of the voltage comparators 328, 329 and the gates of the thyristors 304, 310, and the basis of the transistors 349, 359 are connected to the negative terminal $\overline{Q}$ of the f-f circuit 337 through the resistors 356, 357.

The operation of the modified embodiment will be described with reference to FIG. 18. When the negative waves of the signalling coils 316, 319 are supplied to the reset terminal of the f-f circuit 337, the negative terminal $\overline{Q}$ is changed to a high level to turn on the transistors 349, 350. When the voltages of the signalling coils 316, 319 are changed to the positive polarity, the output terminals of the voltage comparators 328, 329 become a high level. The variation of the voltage is applied to the gates of the thyristors 304, 310 through the capacitors 358, 359 and the transistors 349, 350 to make ignition. At the rising point of the positive voltage of the generating coil 301, a signal is added to the set terminal S of the f-f circuit 337 and the potential at the negative terminal $\overline{Q}$ is changed to a low level to turn off transistors 349, 350. The function by the interruption of signal during the off period of the transistors 349, 350 is similar to that of the embodiment shown in FIG. 17.

Thus, in the fourth embodiment, the ignition signal is generated at the rising point of the output voltage from the signalling coils without causing erroneous ignition by the noise signals, and the ignition timing is kept constant without influence of the revolution of the magnetic generator.

What is claimed is:

1. An ignition device for an internal combustion engine which comprises;

a generating coil for generating a charging output depending on the rotation of an internal combustion engine, an ignition circuit including an ignition capacitor charged by the charging output generated from said generating coil, a signalling coil connected to said ignition circuit and generating an a.c. ignition signal including a continuous one cycle in response to a given crank angle of said engine, and a switching means which renders the ignition signal to become ineffective on the basis of the latter half cycle of the ignition signal from said signalling coil and renders said ignition signal to become effective by releasing the ineffective condition of the ignition signal on the basis of the former half cycle, whereby said ignition signal is supplied to said ignition circuit within an ignition signal effectual period.

2. The ignition device according to claim 1, wherein said switching means is adapted to by-pass the ignition signal during said ignition signal ineffectual period.

3. The ignition device according to claim 1, wherein said switching means is adapted to interrupt the ignition signal during said ignition signal ineffectual period.

4. The ignition device according to claim 1, further comprising a voltage biasing means for biasing the output signal from said signalling coil to produce a comparing signal, and a voltage comparing means for comparing the comparing signal with a reference signal to produce an ignition signal during an ignition signal effectual period.

5. The ignition device according to claim 4, wherein the level of the bias voltage of said voltage biasing means is a level higher than the reference voltage of said comparing means.

6. An ignition device for an internal combustion engine which comprises;

a generating coil for generating a charging output depending on the rotation of an internal combustion engine, an ignition circuit including an ignition capacitor charged by the charging output generated from said generating coil, a plurality of ignition coils which correspond to each cylinder in the internal combustion engine;

a plurality of signalling coils which correspond to each of the cylinders of said engine, in which a first coil produces an a.c. signal including continuous one cycle at a reference position for ignition for a specified one among said cylinders and a second coil produces an a.c. ignition signal including continuous one cycle at a position immediately after said reference position for ignition, and a noise masking circuit which masks the output from each of the signalling coils when charging of said ignition capacitor is initiated; removes the masking upon detection of a first wave of the ignition signal from either of said signalling coils, and causes firing of the ignition coil at the rising point in the positive polarity of a second wave.

7. The ignition device according to claim 6, further comprises a plurality of voltage biasing means for biasing each of the output signal from said signalling coils to produce comparing signals, and a plurality of voltage comparing means for comparing the comparing signals with reference voltages to thereby produce an ignition signal to each of said ignition coils so that timing of application of the electric charge in said ignition capacitor is determined.

8. The ignition device according to claim 7, wherein the level of the bias voltage of said biasing means is a level higher than the reference voltage in each of said comparing means.

* * * * *